US006432905B1

(12) United States Patent
Gowrishankaran et al.

(10) Patent No.: US 6,432,905 B1
(45) Date of Patent: Aug. 13, 2002

(54) DRY NEUTRALIZATION PROCESS FOR DETERGENT POWDER COMPOSITION

(75) Inventors: Chandrasekaran Gowrishankaran; Winston Anthony Pereira, both of Mumbai; Rana Sengupta, Union Territory of Dadra & Nagar Haveli, all of (IN)

(73) Assignee: Unilever Home & Personal Care USA division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/533,218

(22) Filed: Mar. 23, 2000

(30) Foreign Application Priority Data

Mar. 30, 1999 (IN) ..... 228/BOM/99
Jul. 9, 1999 (GB) ..... 9916239

(51) Int. Cl.[7] ..... C11D 17/00

(52) U.S. Cl. ..... 510/441; 510/443; 510/446; 510/452

(58) Field of Search ..... 510/351, 441, 510/443, 446, 452, 536

(56) References Cited

U.S. PATENT DOCUMENTS

| | | | | |
|---|---|---|---|---|
| 3,926,827 | A | 12/1975 | Mangeli | 252/99 |
| 5,451,341 | A | 9/1995 | White | 252/547 |
| 5,478,502 | A | 12/1995 | Swift | 252/549 |

FOREIGN PATENT DOCUMENTS

| | | |
|---|---|---|
| GB | 2323848 | 10/1998 |
| IN | 166307 | 4/1990 |
| WO | 95/23206 | 8/1995 |
| WO | 96/04359 | 2/1996 |

*Primary Examiner*—Necholus Ogden
(74) *Attorney, Agent, or Firm*—Rimma Mitelman

(57) ABSTRACT

The present invention relates to a process for preparing granular detergent products in which a liquid binder component comprising an acid precursor of an anionic surfactant and a hydrotrope is contacted with a solid particulate starting material comprising a neutralizing agent in a low shear mixer and the mixture granulated, the hydrotrope being present at a level of at least 1% by weight of the acid precursor of the anionic surfactant.

9 Claims, No Drawings

DRY NEUTRALIZATION PROCESS FOR DETERGENT POWDER COMPOSITION

TECHNICAL FIELD

The present invention relates to granular detergent products of low to medium bulk density having superior rates of dissolution, flowability and granulometry and their preparation by a dry neutralisation process.

BACKGROUND AND PRIOR ART

There has been considerable interest in the detergent industry for the production of granulated detergent powders exhibiting specific bulk densities.

Generally, detergent powders prepared by spray drying have a low bulk density, for example in the range 350–500 g/l, whilst powders prepared by conventional non-tower routes in which powders are dry-mixed and optionally agglomerated have high bulk densities, for example at least 700 g/l. Powders with an intermediate bulk density, for example in range 450–800 g/l are obtained by mixing powders prepared by spray drying and dry-mix routes in appropriate combinations. However, the capital cost for such a process is very high as spray drying process is capital intensive.

The process of dry neutralisation for preparing detergent powders is known in the art but such a process often results in powders having a high bulk density. WO 96/04359 (Unilever) discloses a process of dry neutralisation for preparing a detergent powder of required bulk density in which it is preferred to choose the particle size distribution of the raw material or add a flow aid. Indian Patent No. 166307 (Hindustan Lever) discloses the specific use of an internal recirculating fluidised bed and mentions that use of a conventional fluidised bed will lead to a lumpy and sticky product.

Hydrotropes have generally been used in liquid detergent compositions to aid phase stabilisation. U.S. Pat. No. 3,926,827 (Colgate-Palmolive) describes hydrotropes as components which can retain oxygen bubbles giving the detergent more volume.

WO95/23206 (Procter & Gamble) discloses a process for making a detergent composition by making a paste comprising a surfactant system and a specific hydrotrope or a mixture and a detergency builder and agglomerating the same. This formulation has a bulk density greater than 650 g/l.

WO 98/44084 (Procter & Gamble) discloses a detergent particle comprising an anionic surfactant and a hydrotrope for use in detergent compositions to provide improved dispensing of the composition. These particles are formed by spray drying a paste or slurry comprising the anionic sulphonate surfactant.

The principal object of the present invention is to provide a non-spray drying process for the preparation of granular detergent compositions with good powder properties and having a bulk density less than 800, preferably less than 700 g/l, more preferably less than 650 g/l. In particular, the detergent composition should have good rates of dissolution, flowability and granulometry.

A further object of the present invention is to provide a process for the preparation of detergent compositions having an intermediate bulk density that is cost effective in comparison to other conventional processes. The applicants have found that the aforesaid objects may be achieved by dry neutralisation of the acid precursor of an anionic surfactant with an alkaline solid in the presence of a hydrotrope such as p-toluene sulphonic acid.

SUMMARY OF THE INVENTION

According to a first aspect, the present invention provides a process for the preparation of a granular detergent product comprising contacting a liquid binder component comprising an acid precursor of an anionic surfactant and a hydrotrope with a solid particulate starting material comprising a neutralising agent in a low shear mixer and granulating the mixture, wherein the hydrotrope is present at a level of at least 1% by weight of the acid precursor of the anionic surfactant.

According to a second aspect, the present invention provides a granular detergent product of bulk density in the range 450 to 800 g/l obtained according to the process of the invention.

DETAILED DESCRIPTION OF THE INVENTION

Definitions

Hereinafter, in the context of this invention, the term "granular detergent product" encompasses granular finished products for sale, as well as granular components or adjuncts for forming finished products, e.g. by post-dosing to or with any other form of admixture with further components or adjuncts.

A granular detergent product as herein defined contains at least 5 wt %, preferably at least 10 wt % of a synthetic anionic surfactant.

As used hereinafter, the term "powder" refers to materials substantially consisting of grains of individual materials and mixtures of such grains. As used hereinafter, the term "granule" refers to a small particle of agglomerated smaller particles, for example, agglomerated powder particles. The final product of the process according to the present invention consists of, or comprises a high percentage of granules. However, additional granular and or powder materials may optionally be post-dosed to such a product.

For the purposes of this invention, the flow properties of the granular product are defined in terms of the dynamic flow rate (DFR), in ml/s, measured by means of the following procedure. A cylindrical glass tube of internal diameter of 35 mm and length of 600 mm is securely clamped with its longitudinal axis in the vertical position. Its lower end is terminated by a cone of polyvinyl chloride having an internal angle of 15° and a lower outlet orifice of diameter 22.5 mm. A first beam sensor is positioned 150 mm above the outlet, and a second beam sensor is positioned 250 mm above the first sensor.

To determine the dynamic flow rate, the outlet orifice is temporarily closed and the cylinder filled with the granular detergent product to a point about 10 cm above the upper sensor. The outlet is opened and the flow time t (seconds) taken for the powder level to fall from the upper sensor to the lower sensor measured electronically. This is repeated 2 or 3 times and an average time taken. If V is the volume (ml) of the tube between the upper and lower sensors, the DFR is given by V/t.

Unless specified otherwise, values relating to powder properties such as bulk density, relate to the weathered granular detergent product.

The Process

The process involves dry neutralisation of the acid precursor of an anionic surfactant with a solid neutralising agent in the presence of a hydrotrope such as p-toluene sulphonic acid.

The Low Shear Mixer

The process of this invention is carried out in a low shear mixer. Suitable low shear mixers for use in the process include rotating bowl mixers, drum mixers or concrete mixers. A low shear mixer of the gas fluidisation type which comprises a fluidisation zone into which the liquid binder is sprayed onto the solid material may also be used.

The liquid binder components may simply be pumped into the low shear mixer or may be introduced as a spray. The liquid binder is preferably sprayed into the low shear mixer.

In a preferred embodiment, the acid precursor of the anionic surfactant and the hydrotrope are at a temperature greater that 50° C., preferably greater than 55° C. when fed to the mixer and contacted with the solid starting material. If other components are present in the liquid binder, it is also preferred that these components be at a temperature greater that 50° C., preferably greater than 55° C. when fed to the mixer.

In a highly preferred embodiment, the acid precursor of an anionic surfactant and the hydrotrope are heated together to a temperature above 50° C. and then sprayed onto the solid starting material, preferably through the same nozzle, using a pump into a low shear mixer.

It has been found that in order to achieve the benefit of the invention, the acid precursor of the anionic surfactant and the hydrotrope must be added substantially simultaneously to the low shear mixer. This may be done by adding the two components simultaneously but in separate streams to the mixer. However, it is highly preferred that the two components are brought together prior to being fed into the mixer and are fed as a single stream.

Another important process parameter is the addition of the acid precursor and the hydrotrope to the low shear mixer. It is preferred that the rate and manner of addition are such that the acid precursor is immediately consumed (neutralised) so that acid precursor does not accumulate in the mixer in unreacted form. This also applies to hydrotropes which are acids.

The Liquid Binder

The liquid binder comprises as essential components an acid precursor of an anionic surfactant and a hydrotrope.

The liquid acid precursor may be selected from linear alkyl benzene sulphonic (LAS) acids, alphaolefin sulphonic acids, internal olefin sulphonic acids, fatty acid ester sulphonic acids, alkyl sulphuric acids, fatty acids and combinations thereof. The process of the invention is especially useful for producing compositions comprising alkyl benzene sulphonates by reaction of the corresponding alkyl benzene sulphonic acid, for instance Dobanoic acid ex Shell. Linear or branched primary alkyl sulphates (PAS) having 10 to 15 carbon atoms can also be used.

Suitable hydrotropes that can be applied to the process of the invention include para-toluene sulphonic acid, sulfyl succinates, xylene sulphonates, cumene sulphonates and others known in the art. In a preferred embodiment, the hydrotrope is para-toluene sulphonic acid either alone or as a mixture with another hydrotrope. References made herein to para-toluene sulphonic acid are also taken to include any salts thereof and in particular the sodium salt.

The content of acid precursor of an anionic surfactant in the liquid binder may be as high as possible, e.g. at least 98 wt % of the liquid binder, or it may be less than 75 wt %, less than 50 wt % or less than 25 wt %. Preferably it is at least 10 wt %, more preferably at least 25 wt %, more preferably at least 50 wt %, yet more preferably at least 75 wt % and most preferably at least 90 wt % of the liquid binder.

The content of hydrotrope in the liquid binder is at least 1, preferably at least 2.5, more preferably at least 5 wt % of the amount of acid precursor of anionic surfactant present in the liquid binder.

In a preferred embodiment, the liquid binder essentially consists of an acid precursor of an anionic surfactant and a hydrotrope.

However, in addition to an acid precursor of an anionic surfactant and a hydrotrope, the liquid binder may comprise one or more other components of the granular detergent product. Suitable liquid components include anionic surfactants (i.e. neutralised salts), nonionic surfactants, fatty acids, water and organic solvents. The liquid binder can also comprise solid components dissolved in or dispersed in a liquid component. The only limitation is that with or without dissolved or dispersed solids, the liquid binder should be pumpable and capable of being delivered to the low shear mixer in a fluid, including paste-like, form. Suitable anionic surfactants are well-known to those skilled in the art. Examples suitable for incorporation in the liquid binder include alkylbenzene sulphonates, particularly linear alkylbenzene sulphonates having an alkyl chain length of $C_8$–$C_{15}$; primary and secondary alkyl sulphates, particularly $C_{12}$–$C_{15}$ primary alkyl sulphates; alkyl ether sulphates; olefin sulphonates; dialkyl sulphosuccinates; and fatty acid ester sulphonates. Sodium salts are generally preferred.

If a neutralised anionic surfactant is employed in the liquid binder, it is very much preferred to form some or all of any anionic surfactant in situ in the liquid binder by reaction of an appropriate acid precursor and an alkaline material such as an alkali metal hydroxide, e.g. NaOH. Since the latter normally must be dosed as an aqueous solution, that inevitably incorporates some water. Moreover, the reaction of an alkali metal hydroxide and acid precursor also yields some water as a by-product.

However, in principle, any alkaline inorganic material can be used for the neutralisation but water-soluble alkaline inorganic materials are preferred. Another preferred material is sodium carbonate, alone or in combination with one or more other water-soluble inorganic materials, for example, sodium bicarbonate or silicate.

Suitable nonionic surfactants that can be included as a component of the liquid binder include any one or more liquid nonionics selected from primary and secondary alcohol ethoxylates, especially $C_8$–$C_{20}$ aliphatic alcohols ethoxylated with an average of from 1 to 20 moles ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

In a preferred embodiment the liquid binder is substantially non-aqueous. That is to say, the total amount of water therein is not more than 15 wt % of the liquid binder, preferably not more than 10 wt %. However, if desired, a controlled amount of water may be added to facilitate neutralisation.

The Solid Starting Material

The solid starting materials of this invention are particulate and may be powdered and/or granular. In addition to comprising a neutralising agent, the solid starting material may be any component of the granular detergent product that is available in particulate form. Preferably, the solid starting material with which the liquid binder is admixed comprises a detergency builder.

In a preferred embodiment, the neutralising agent is a water-soluble alkaline inorganic material, preferably a alkali metal salt. Suitable neutralising agents include alkali metal carbonates, bicarbonates and silicates, e.g. the sodium salts. These may be used alone or in combination. Preferably, the neutralising agent comprises sodium carbonate.

The neutralising agent is very preferably present at a level sufficient to neutralise fully the acidic component. If desired, a stoichiometric excess of neutralising agent may be employed to ensure complete neutralisation and/or to provide an alternative function, for example as a detergency builder, e.g. if the neutralising agent comprises sodium carbonate.

The Product

The present invention also encompasses a granular detergent product resulting from the process of the invention (before any post-dosing or the like).

Granular detergent products according to the invention have a bulk density of less than 800 g/l, preferably less than 750 g/l, more preferably less than 700 g/l, and most preferably less than 650 g/l. The bulk density may be as low as 450 g/l, however it is preferably at least 500 g/l. Preferably it is in the range from 450, more preferably 500 g/l up to less than 700, more preferably 650 g/l.

The granular detergent products produced according to the process of this invention have one or more enhanced powder properties. For example, the granular products have been found to have improved rate of dissolution, flowability and granulometry.

The granular product is considered to be free flowing if it has a DFR of at least 80 ml/s. Preferably the granular products of this invention have DFR values of at least 80 ml/s, preferably at least 90 ml/s, more preferably at least 100 ml/s, and most preferably at least 110 ml/s.

Detergent Compositions and Ingredients

As previously indicated, a granular detergent product prepared by the process of the invention may itself be a fully formulated detergent composition, or may be a component or adjunct which forms only a part of such a composition. This section relates to final, fully formed detergent compositions, unless specifically indicated otherwise as relating to the granular detergent product.

The total amount of detergency builder in the final detergent composition is suitably from 5 to 80 wt %, preferably from 5 to 60 wt %, more preferably from 10–35 wt %. The builder may be present in an adjunct with other components or, if desired, separate builder particles containing one or more builder materials may be employed.

In a preferred embodiment, the amount of builder material incorporated as part of the solid particulate starting material of the process is such that the final builder content in the composition is from 5 to 60 wt %, preferably from 10–35 wt % of the granular detergent product.

A preferred builder is sodium carbonate, which may be the residue of an inorganic alkaline neutralising agent used to form anionic surfactant in situ. Sodium carbonate, when present, preferably comprises 4 to 40 wt % of the final detergent composition.

Examples of other suitable builders which may be present as solid starting material or subsequently mixed with the granular detergent product to form the final detergent compositions include alkali metal crystalline or amorphous aluminosilicates, sulphates and phosphates, and mixtures thereof.

Organic builders, such as for example citrate, polyacrylates etc, may also be present as will be evident to the person skilled in the art.

The granular detergent compositions may contain, in addition to any anionic and/or nonionic surfactants of the liquid binder, one or more other detergent-active compounds which may be chosen from soap and non-soap anionic, cationic, nonionic, amphoteric and zwitterionic surfactants, and mixtures thereof. These may be dosed at any appropriate stage before or during the process. Many suitable detergent-active compounds are available and are fully described in the literature, for example, in "Surface-Active Agents and Detergents", Volumes I and II, by Schwartz, Perry and Berch.

The preferred detergent-active compounds that can be used are soaps and synthetic non-soap anionic and nonionic compounds.

Preferred detergent compositions according the invention comprise from 5 to 30 wt % anionic surfactant, from 0 to 4 wt % nonionic surfactant and from 0 to 5 wt % fatty acid soap.

The level of hydrotrope in the final detergent composition is from 0.25, preferably from 0.5, more preferably from 1 up to 5 wt %.

The detergent compositions may also contain a bleach system, desirably a peroxy bleach compound, for example, an inorganic persalt or organic peroxyacid, capable of yielding hydrogen peroxide in aqueous solution. The peroxy bleach compound may be used in conjunction with a bleach activator (bleach precursor) to improve bleaching action at low wash temperatures. An especially preferred bleach system comprises a peroxy bleach compound (preferably sodium percarbonate) optionally together with a bleach activator.

Usually, any bleach and other sensitive ingredients, such as enzymes and perfumes, will be post-dosed after granulation along with other minor ingredients.

Typical minor ingredients include sodium silicate; corrosion inhibitors including silicates; antiredeposition agents such as cellulosic polymers; fluorescers; inorganic salts such as sodium sulphate, lather control agents or lather boosters as appropriate; proteolytic and lipolytic enzymes; dyes; coloured speckles; perfumes; foam controllers; and fabric softening compounds. This list is not intended to be exhaustive.

Optionally, a "layering agent" or "flow aid" may be introduced at any appropriate stage in the process of the invention. This is to improve the granularity of the product, e.g. by preventing aggregation and/or caking of the granules. Any layering agent flow aid is suitably present in an amount of 0.1 to 15 wt % of the granular product and more preferably in an amount of 0.5 to 5 wt %.

Suitable layering agents/flow aids include crystalline or amorphous alkali metal silicates, aluminosilicates including zeolites, citrates, Dicamol, calcite, diatomaceous earths, silica, for example precipitated silica, chlorides such as sodium chloride, sulphates such as magnesium sulphate, carbonates such as calcium carbonate and phosphates such as sodium tripolyphosphate. Mixtures of these materials may be employed as desired.

Zeolite MAP is especially useful as a layering agent. Layered silicates such as SKS-6 ex Clariant are also useful as layering agents.

Powder flow may also be improved by the incorporation of a small amount of an additional powder structurant, for example, a fatty acid (or fatty acid soap), a sugar, an acrylate or acrylate/maleate polymer, or sodium silicate which is suitably present in an amount of from 1 to 5 wt %.

In general, additional components may be included in the liquid binder or admixed with the solid starting material at an appropriate stage of the process. However, solid components can be post-dosed to the granular detergent product.

The granular detergent composition may also comprise a particulate filler (or any other component which does not contribute to the wash process) which suitably comprises an inorganic salt, for example sodium sulphate and sodium chloride. The filler may be present at a level of 5 to 70 wt % of the granular product.

The objects of the invention and its advantages are now illustrated by the following non-limiting examples:

EXAMPLES

Process for Preparing the Detergent Composition

The granular detergent composition of Example 1 was prepared by the following process.

41.9 kg of particulate starting material comprising sodium carbonate, sodium tripolyphosphate (STPP) and sodium chloride was charged into a 200 liter capacity rotating bowl mixer. 10.4 kg of linear alkylbenzene sulphonic acid (LAS), 1.5 kg of para-toluene sulphonic acid (PTSA) and catalysing water was charged into a 25 liter dosing tank. This liquid mixture was heated to 60° C. whilst being kept under agitation. The liquid mixture was then sprayed onto the particulates in the rotating bowl mixer through a multiple head nozzle. The contents were mixed for 60 seconds to allow complete neutralisation. Finally, 0.9 kg minor ingredients such as anti-redeposition agents, flourescers, flow aids were added and mixed for 20 seconds.

Examples A and B were prepared by the same procedure, apart from in Example A, no PTSA was added and the amount of water adjusted accordingly, and in Example B, the LAS and PTSA were added sequentially. In Example B, the PTSA was added done after completing the addition of LAS on to the particulates in the rotating bowl mixer.

Results

The different properties such as bulk density, rate of dissolution and dynamic flow rate of compositions prepared based on the formulations described in Table 1 was determined using standard test procedures.

TABLE 1

| Components | Example 1 Wt % | Example A Wt % | Example B Wt % |
|---|---|---|---|
| Linear alkyl benzene sulphonic acid | 20 | 20 | 20 |
| Builders Sodium carbonate & STPP | 52 | 52 | 52 |
| PSTA | 2 | — | 2 |
| Fillers | 17 | 17 | 17 |
| Minor ingredients | 6.8 | 6.8 | 6.8 |
| Water | to 100% | to 100% | to 100% |

TABLE 1-continued

| Components | Example 1 Wt % | Example A Wt % | Example B Wt % |
|---|---|---|---|
| PROPERTIES | | | |
| Bulk density g/l | 600 | 650 | 660 |
| Rate of dissolution % | 88 | 80 | 80 |
| Dynamic flow rate | 144 | nil-very sluggish | Nil-very sluggish |

The detergent powder of Example 1 has far superior flow properties compared to Examples A and B. In addition, the rate of dissolution of the powder of Example 1 is significantly better than that of Examples A and B.

We claim:

1. A process for the preparation of a granular detergent product comprising contacting a liquid binder component comprising an acid precursor of an anionic surfactant and a hydrotrope with a solid particulate starting material comprising a neutralising agent in a low shear mixer and granulating the mixture, wherein the hydrotrope is present at a level of at least 1% by weight of the acid precursor of the anionic surfactant.

2. A process according to claim 1, in which the acid precursor of the anionic surfactant and the hydrotrope are added substantially simultaneously to the mixer.

3. A process according to claim 1, in which the acid precursor of the anionic surfactant and the hydrotrope are added as a single stream.

4. A process according claim 1, in which the acid precursor of the anionic surfactant and the hydrotrope are at a temperature greater than 50° C. when contacted with the solid starting material.

5. A process according to claim 1, in which the acid precursor of the anionic surfactant is a linear alkyl benzene sulphonic acid.

6. A process according to claim 1, in which the hydrotrope is para-toluene sulphonic acid.

7. A process according to claim 1, in which the neutralising agent is a water-soluble alkaline inorganic material.

8. A process according to claim 7, in which the neutralising agent is an alkali metal carbonate, bicarbonate or silicate.

9. A granular detergent product of bulk density in the range 450 to 800 g/l obtained according to the process of claim 1.

* * * * *